US006354512B2

(12) United States Patent
Vennell

(10) Patent No.: US 6,354,512 B2
(45) Date of Patent: Mar. 12, 2002

(54) POLYMER EMBEDMENT OF RAILS

(75) Inventor: Robert Paul Vennell, Trowbridge (GB)

(73) Assignees: Hyperlast Limited, Manchester; ALH Rail Coatings Limited, North Lincolnshire, both of (GB)

( * ) Notice: Subject to any disclaimer, the term of this patent is extended or adjusted under 35 U.S.C. 154(b) by 0 days.

(21) Appl. No.: 09/881,837

(22) Filed: Jun. 18, 2001

Related U.S. Application Data

(62) Division of application No. 09/284,506, filed as application No. PCT/GB97/03000 on Oct. 31, 1997, now Pat. No. 6,270,017.

(30) Foreign Application Priority Data

Nov. 4, 1996 (GB) ..... 9622924

(51) Int. Cl.[7] ..... B29D 31/00
(52) U.S. Cl. ..... 238/2; 238/382
(58) Field of Search ..... 238/2, 3, 8, 83, 238/84, 91, 95, 96, 97, 122, 150, 382; 264/212, 279, 279.1; 425/129.1, 110, 127, 112, 117

(56) References Cited

U.S. PATENT DOCUMENTS

| | | | | | |
|---|---|---|---|---|---|
| 3,991,146 | A | * | 11/1976 | Barrie | 264/279 |
| 4,824,627 | A | * | 4/1989 | Hammer et al. | 264/279.1 |
| 5,181,657 | A | * | 1/1993 | Davis | 238/8 |
| 5,285,964 | A | * | 2/1994 | Vanotti | 238/7 |
| 5,470,173 | A | * | 11/1995 | Schmidt | 404/32 |
| 5,538,182 | A | * | 7/1996 | David et al. | 238/8 |
| 5,655,711 | A | * | 8/1997 | Hull | 238/8 |
| 5,788,153 | A | * | 8/1998 | Ortwein | 238/7 |
| 5,792,481 | A | * | 8/1998 | Cretti | 264/212 |
| 5,850,970 | A | * | 12/1998 | Hull et al. | 238/8 |
| 5,890,811 | A | * | 4/1999 | Bryson | 384/42 |
| 5,899,379 | A | * | 5/1999 | Bruyn et al. | 238/8 |

FOREIGN PATENT DOCUMENTS

| | | |
|---|---|---|
| DE | 38 24577 A1 | 1/1990 |
| EP | 0 364 756 A3 | 4/1990 |
| EP | 0 628 660 A1 | 12/1994 |

OTHER PUBLICATIONS

"Dynamics Holds the Key to Whole Life Costs" Baxter, *Railway Gazette International*, No. 5, May 1993, Sutton, Surrey, Great Britain.

* cited by examiner

*Primary Examiner*—Mark T. Le
(74) *Attorney, Agent, or Firm*—Larson & Taylor PLC

(57) ABSTRACT

A method of making a polymer coated rail in which a rail to be coated (10) is positioned on a mould base (11) in an inverted manner, so that the head (12) of the rail is immediately adjacent the base plate (11). Then, mould side pieces (13, 14) are secured to the base plate (11) to run parallel to the side of the rail (10). Antislip material such as bauxite or granite chippings (21) are positioned in the mould so that they lie on the base plate (11), and then the liquid polymer is poured into the mould to fill the spaces (19, 20) and so encapsulate the rail (10). The polymer is poured into the mould, until its surface (22) covers the foot (23) of the rail. In this state, the polymer is allowed to cure, so that it solidifies, and once the side plates (13, 14) have been removed, the rail together with its polymer coating can be lifted from the base plate (11).

5 Claims, 5 Drawing Sheets

POLYMER EMBEDMENT OF RAILS

This application is a divisional of prior application Ser. No. 09/284,506 filed Apr. 14, 1999, now U.S. Pat. No. 6,270,017 which is a 371 of PCT/GB97/03000 filed Oct. 31, 1997.

TECHNICAL FIELD

The present invention relates to polymer embedment of rails for railway lines.

BACKGROUND ART

With the reintroduction of street tramways (light railways) in the UK and the upgrading and extension of existing tram networks world wide, there is a continual need to improve products and methods of installation to keep in line with various installation requirements and to be able to compete within the market place.

It is no longer acceptable for tramlines to be noisy, cause vibration in surrounding structures or to damage the statutory undertaker pipes, cables or ducts due to corrosion from stray electrical currents running through the rails.

At present the method of fixing a rail into the street requires the following to be taken into account. Firstly, the rail must be held extremely securely in its correct position. Standardly, this is done by providing a track bed into which the rail line is positioned for fixing. This may cause difficulties in positioning the rail and maintaining that position while the rail is fixed into the street. Secondly, the method of fixing the rail must provide for reduction in both noise and vibration caused by the trams along the lines and also prevent any stray electrical current passing from the rail in to the neighbouring surroundings. Thirdly, because the rail lines are fixed into the street it is important that the method of fixing and the form of fixant used does not cause a hazard to other street users.

Many track bed construction methods are available to fix the rail into the correct position in the street but, many of these systems fail to fulfill the above mentioned requirements.

There are, however, two distinct methods which go part way to satisfying the requirements, namely a) provision of pre-vulcanised rubber sections that are fitted around the rail; and b) the use of liquid polyurethane rubber which is poured around a preinstalled rail to fully encapsulate the rail.

Although the pre-vulcanised rubber section method provides a lower installation cost the poured polymer method comes closer to fulfilling the requirements of rail line fixing.

The poured polymer system requires a concrete track slab to be formed into which two slots that hold the rails have been preformed. The track slab has to be formed very accurately as the position of the slots determines both the final vertical and horizontal alignment of the top of the rail. That alignment is also dependent on the roadways and streets surrounding the track slab, and this means that the positioning is an extremely difficult task. Variations in the slot width or depth results in the increase in the amount of polymer being used, hence cost.

For the system to work effectively the poured polymer must bond to the rail and the concrete slot. Before the polymer is applied, both substrates must be dry and therefore the entire working area must be protected from the wet weather.

It is possible with poured systems to add to the top layer of the polymer, i.e at the road surface, a variety of anti-skid materials e.g. bauxite or granite chippings. However, in order to prevent the heavier anti-skid materials from sinking into the polymer away from the surface, they have to be added in a separate top layer of polymer once the rest of the polymer has started to solidify.

DISCLOSURE OF THE INVENTION

In order to address these problems, the applicants have decided to depart from the existing poured polymer systems, by coating the rail with a poured polymer with the rail in a mould, and then curing the polymer in the mould, enabling the rail to be coated off-site. Furthermore, the rail is coated in the mould when the rail is inverted, ie. the head of the rail is at the bottom of the mould.

This method has several advantages. Firstly, because the rail is inverted, the mouth of the mould corresponds to the foot of the rail, which in general is wider than the head of the rail. Thus, the mould can be shaped to minimise the amount of polymer needed, and yet have a wide mouth to permit the polymer to be poured in easily.

Secondly, the fact that the rail is coated in the polymer off-site by a poured polymer arrangement means that there is chemical bonding of the polymer to the rail, as in the existing on-site arrangements, but the coating of the rail may be carried out in factory-controlled conditions.

It may be possible for the concrete slot known in prior art methods to be considered the "mould" described is the method which in the first aspect of the invention. If this is so, the coated rail is never removed from the "mould" in these prior art methods.

If anti-skid materials are to be added into the mould, they can be added before the polymer is poured in and they will rest naturally by gravity at the bottom of the mould, and thus be in the polymer adjacent the head of the rail without requiring successive layers of polymer.

It should be noted that, since the polymer is an expensive component in the present invention, it is preferable that the mould is shaped similar to keep small the amount polymer needed. Many different mould shapes are possible, including those which conform generally to the profile of the rail, and also including arrangements in which the mould tapers towards the head of the rail.

Also, it is possible to make use of ballast blocks attached to the rail using eg. an epoxy resin. Such ballast blocks are known in the art, and assist in the attenuation of noise and vibration. In the present invention, they also have the added advantages of filling part of the hollow interim of the mould, so reducing the amount of polymer needed. For the sake of convenience in this specification, such ballast blocks are considered optional parts of the "rail", so that the "rail" includes structures where such ballast blocks are present, as well as those where they are not.

First, in order to install a rail line in a track bed, the rail will be coated with a poured polymer in a mould, with the rail head-down in the mould, the coated rail is transported to the site in which it is to be positioned with or without the mould in place, the mould is removed, and the rail and coating (which is now solid) is mounted on a track bed and fixed thereto for subsequent use.

The track bed may have two parallel slots therein, to receive two coated rails, but it is preferable to use a flat track bed, of eg. concrete with the coated rails being held apart by tie-rods whilst they are secured to the track bed. A further layer of eg. concrete may then be formed on the track bed, to embed the coated-rail. In a development of this, that additional layer of concrete does not extend to the top of the head of the rail; instead it extends parts of the way up the rail and a layer of eg. asphalt is then placed on top of the concrete. In such an arrangement the head of the rail is at the ground surface when in place. This is particularly useful in a light railway where the tracks run in a road to be used by other vehicles.

Thus, in order to coat the rail blocks, they may be held within a mould generally complementary to the perimeter of the rail block so as to minimise the amount of polymer required within the mould to coat the rail block. Once positioned within the mould the polymer is poured in so as to cover the rail and allowed to set into a solid. The mould is then removed and the rail block is ready for installation.

By inverting the rail block within the mould, in other words placing the head of the rail upon which the tram will run at the base of the mould, anti-skid material may be poured into the mould before the polymer is poured in. In this way there is no need for a separate process step and the risk of the layer containing the anti-skid material separating from the remaining polymer coating is dramatically reduced.

The present invention relates to a method of coating a rail as discussed above, and also to a coated rail thus formed. Although the present invention has been developed for rails to be used in light railways, or tram systems, where the rails are mounted in a road to be used by other vehicles, the present invention is not limited to this and may be used for any rail system. The invention may also be applied to curved rails, such as transition rails.

BRIEF DESCRIPTION OF DRAWINGS

Embodiments of the present invention will now be described in detail, by way of example, with reference to the accompanying drawings in which.

DETAILED DESCRIPTION

Figure 1:
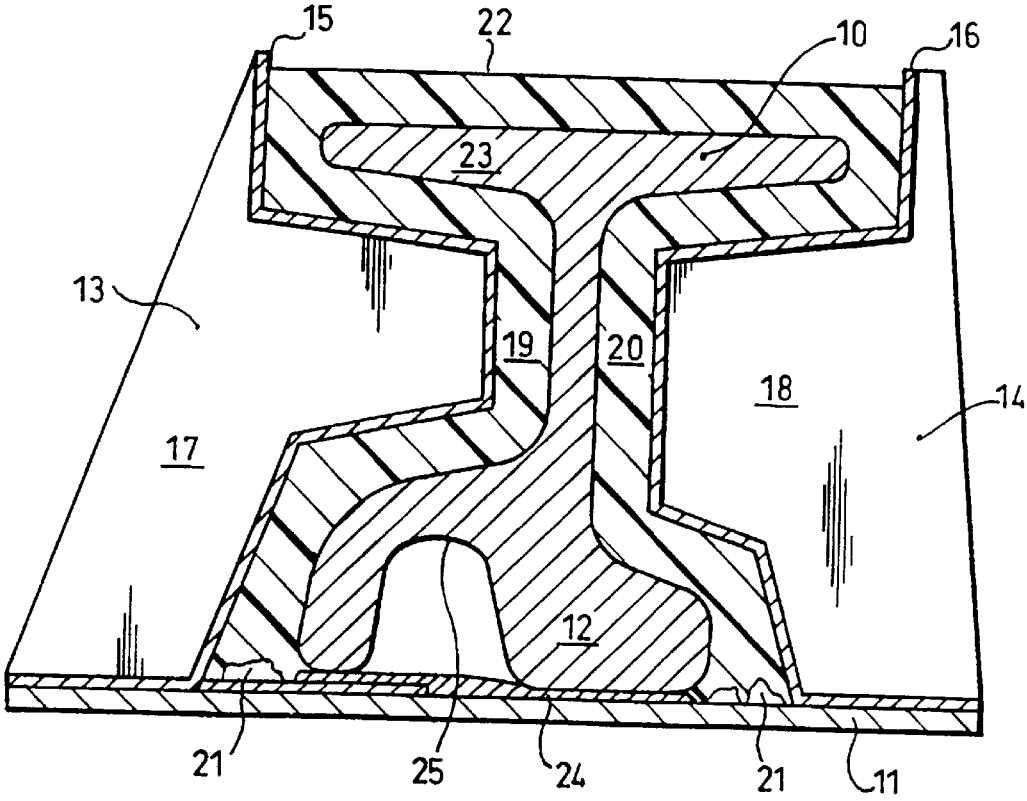
FIG. 1 shows the coating of a rail by poured polymer according to a first embodiment of the present invention.

Referring first to FIG. 1, a rail 10 is to be coated with a polymer. The polymer is a liquid polyurethane rubber such as that known as Series Six.

In order to coat the rail 10, the rail 10 is positioned on a mould base-plate 11 in an inverted manner, ie. the head 12 of the rail is immediately adjacent the base-plate 11. Then, mould side pieces 13, 14 are secured to the base-plate 11 to run generally parallel to the side of the rail 10. As can be seen from FIG. 1, the side pieces 13, 14 each comprise a wall 15, 16 which conforms generally to the shape of the rail 10, and side flanges 17, 18 which ensure that the walls 15, 16 maintain their shapes.

When the side pieces 13, 14 are mounted on the base-plate 11, there are spaces 19, 20 between the rail 10 and the walls 15, 16. The spaces 19, 20 are to be filled with the pourable polymer. However, before the polymer is poured into the mould formed by the base-plate 11 and the side pieces 13, 14, anti-slip material such as bauxite or granite chippings are positioned in the mould so that they lie on the base plate 11. Such anti-slip materials are shown schematically at reference 21 in FIG. 1. Then, a liquid polymer is poured into the mould, to fill the spaces 19, 20 and so encapsulate the rail 10. As can be seen from FIG. 1, the polymer is poured into the mould until its surface 22 covers the foot 23 of the rail. In this state, the polymer is allowed to cure, so that it solidifies, and the mould parts 13, 14, are then removed. The rail 10, together with its polymer coating, can then be lifted from the base plate 11. The anti-slip materials 21 are encapsulated in the polymer, because the polymer will flow around them when the polymer is poured into the mould, so that the surface of the polymer adjacent the rail head 12 is thus provided with a non-slip structure without requiring more than one polymer-pouring step.

FIG. 1 also shows that a packer layer 24 may be placed between the rail head 12 and the base-plate 11. That packer layer 24 prevents polymer seeping between the rail head 12 and the base-plate 11, and so coating the lowermost surface of the rail head 12, which surface will be exposed in use. It also prevents polymer reaching the groove 25 in the rail head 12 which receives the flange of the wheel of the vehicle running on the track when the rail is in use.

Figure 2:
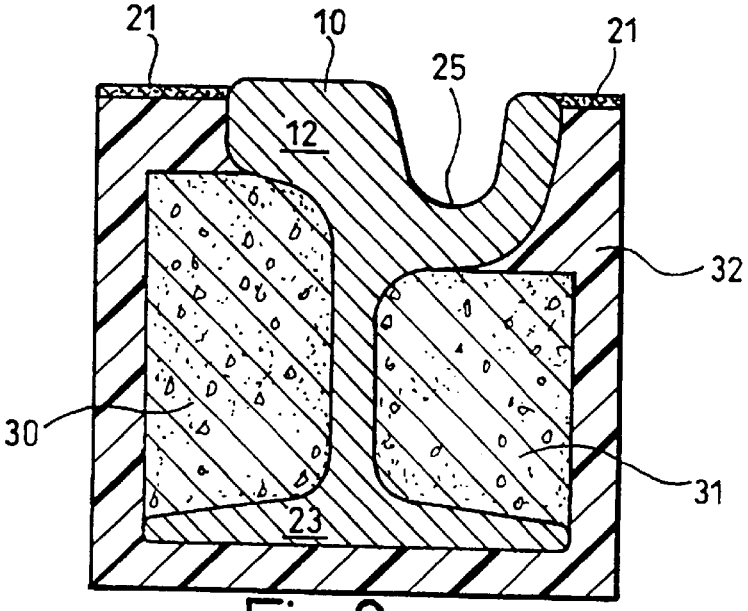
FIG. 2 shows a coated rail according to a second embodiment of the present invention.

In the embodiment of FIG. 1, the walls 15, 16 of the mould parts 13, 14 is shaped as to conform generally to the shape of the rail 10, so as to minimise the amount of polymer needed. The embodiment of FIG. 2 shows an alternative arrangement. In that alternative arrangement, corresponding parts are indicated by the same reference numerals.

In the arrangement of FIG. 2, concrete blocks 30, 31 are mounted on the rail between the rail head 12 and the rail foot 23. A mould in which the side walls are generally upright is then used, so that the cured polymer material 32, cured has a generally square or rectangular outer cross-section.

In the embodiment of FIG. 2, the concrete blocks 30, 31 reduce noise and vibration of the rail 10, and also have the effect of partially filling the hollow interior of the mould, thus keeping small the amount of polymer material needed.

Once the rail 10 has been coated with polymer 32, and the polymer allowed to harden, the coated rail may be transported to the site in which it is to be used, and mounted in a track bed.

An example of the mounting of the rail on a track bed will now be discussed in detail, using the coated rail according to the embodiment of FIG. 1, with corresponding parts being indicated by the same reference numerals. The polymer coating on the rail, in its harden state, is shown by reference numeral 32 as in FIG. 2.

Figure 3A:
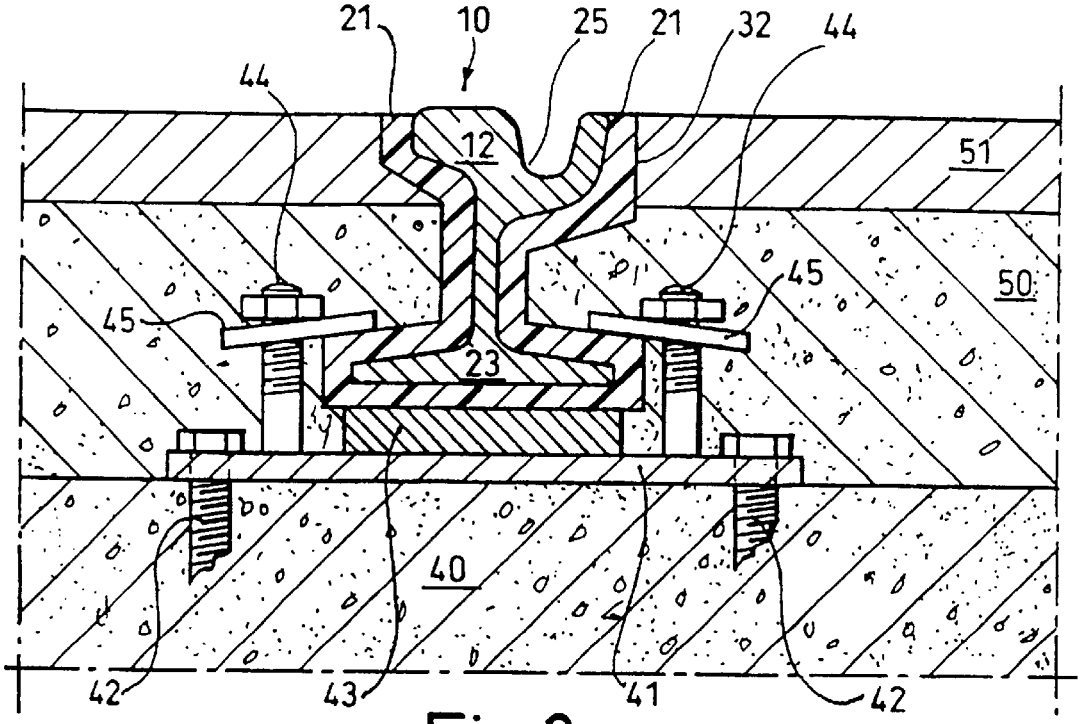
FIG. 3*a* shows a track bed for use with the coated rail of FIG. 1.

In the arrangement of FIG. 3*a*, a concrete track bed 40 has a mounting plate 41 secured thereto by fixing bolts 42. The coated rail is then positioned on the mounting plate 41, either directly or with a spacer block 43 intervening, depending on the desired height of the rail head 12. The mounting plate has further bolts 44 extended therefrom which carry abutment plates 45. As shown in FIG. 3*a*, those abutment plates extend over the coating 32 adjacent the foot 23 of the rail to force the foot 23 firmly onto the base plate 41, via the spacer block 43 if necessary.

Then, the track bed 40 is flooded with concrete to form an infill layer 50 which embeds the majority of the rail 10, thus firmly fixing the rail 10 to the track bed 40. Finally, a layer 51 of asphalt is formed over the infill layer 50 to a depth such that the top surface of the asphalt is aligned with top surface of the head 12 of the rail 10. The rail is then held securely. Although part of the coating 32 is exposed between the asphalt layer 51 and the rail head 10, the presence of the anti-slip material prevents that exposed coating causing a problem for other vehicles.

An alternative arrangement is shown in FIG, 3*b*, in which the mounting plate can be secured to the concrete track bed 40 at a distance, by fixing bolts 42 and fixing nut 46. The coated rail is then positioned directly on the mounting plate 41, and held in place as in FIG. 3*a*. Thus the height of the rail may be adjusted by altering the position of the bolts 42, and when the track bed 40 is flooded with concrete to form an infill layer 50, the concrete penetrates underneath the base plate 41, thus eliminating any instability introduced by having a spacer block 43 present in the construction. The rail construction is finished as that in FIG. 3*a*.

Of course, for any rail system, there will normally be two rails spaced apart by the correct distance for the rail vehicles which are to be used, and for this reason it may be necessary for the pair of rails to be held together by a tie rod, at least until the rails have been fixed to the base plate 41. The tie rods may then be removed since the concrete infill layer 50 prevent actual movement of the rails.

Many different coated rail arrangements are possible, and some of the arrangements which have been envisaged are shown in FIGS. 4 to 9. In the following embodiments, corresponding parts are indicated by the same reference numerals, which are also the same as used in FIG. 2.

Figure 4:
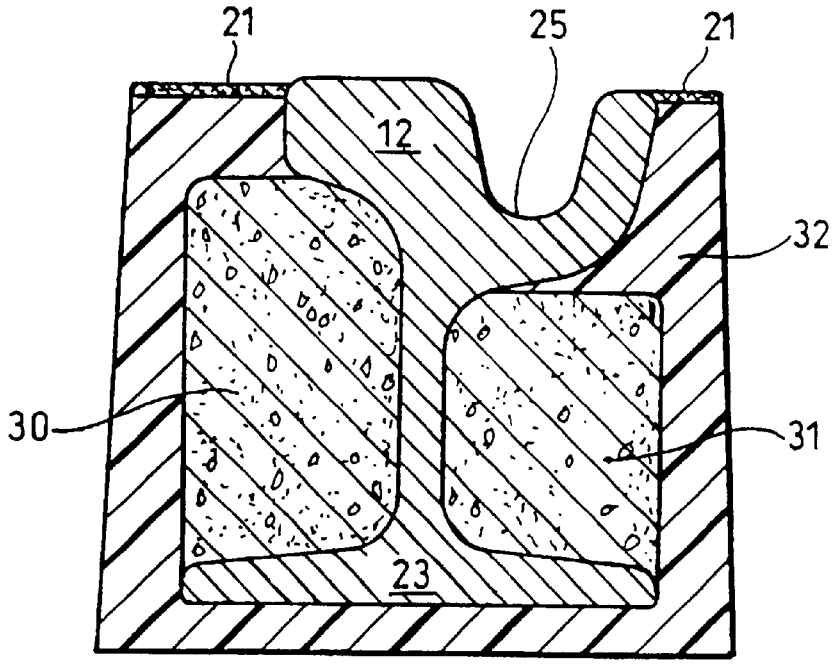
FIGS. 4 to 9 show further embodiments of coated rails according to the present invention.

In the embodiment of FIG. 4, the cured polymer 32 is tapered so that it has a narrower transverse width adjacent the head 12 of the rail 10 than at the rail 23. This is achieved by tapering the mould so that its mouth is wider than its base. Such as arrangement has the advantage of maximising the polymer coating around the foot 23, without exposing a large polymer surface at the ground level.

Figure 5:
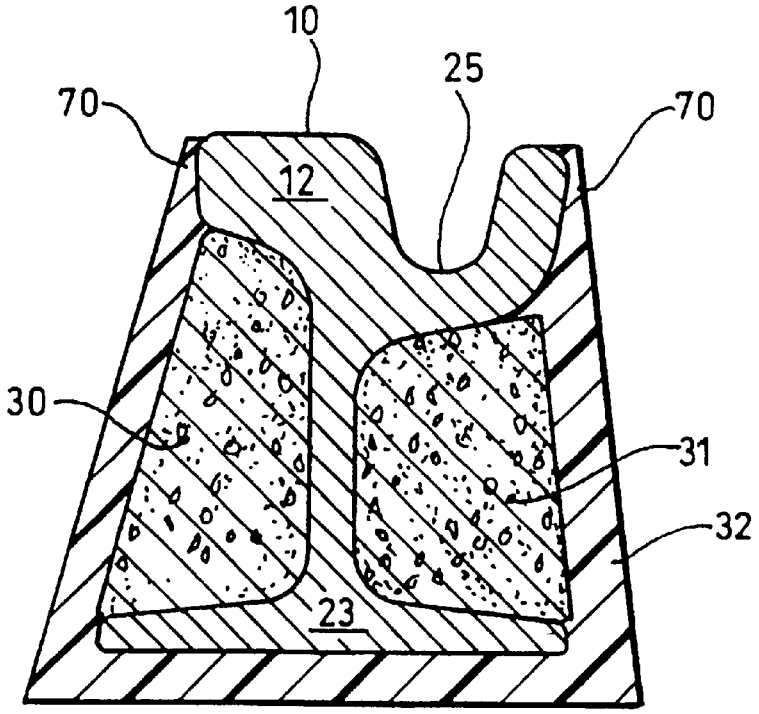

This tapering is accentuated in the embodiment of FIG. 5, in which the taper is such that there is only a very thin coating 70 of polymer around the head 12 of the rail 10. In such an embodiment, there is no anti-slip material 21 but this is not a problem since the amount of polymer exposed at the ground surface is very small, so that slippage is extremely unlikely. The polymer coating 70 at the head 12 needs to be sufficiently thick to give electrical insulation, and that is all.

Figure 3B:
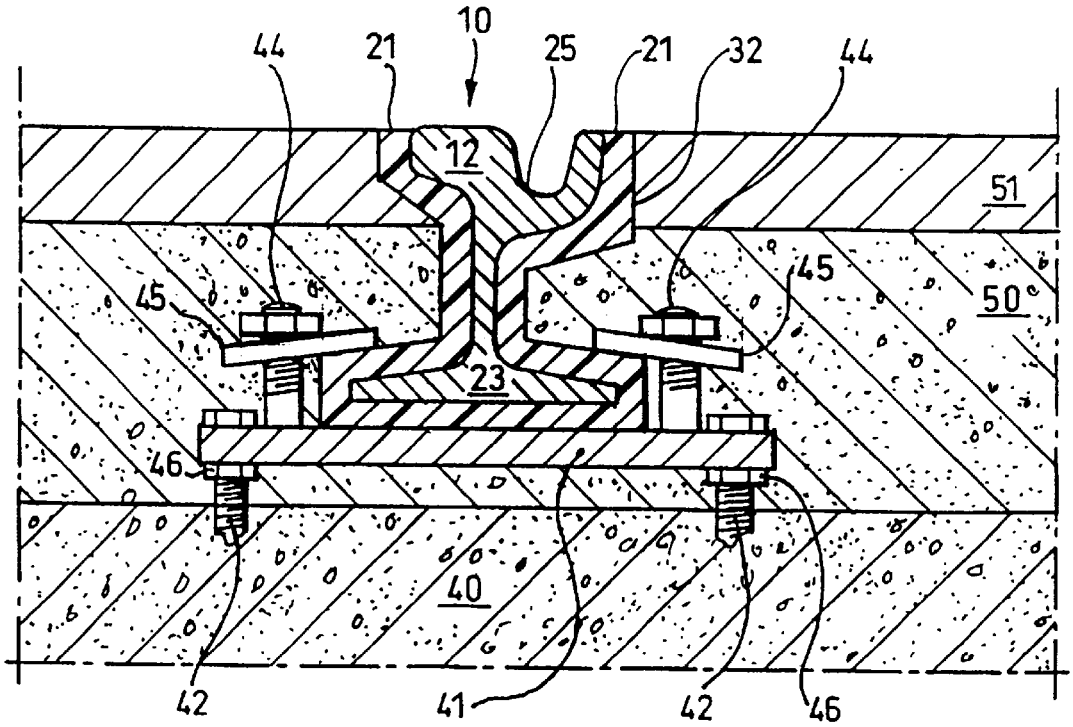
FIG. 3*b* shows an alternative arrangement of the track bed in FIG. 3*a*.

One potential disadvantage of the present invention arises because the coated rail is formed off-site. Then, there may be small gaps between the coated rails and the surrounding material, such as the concrete infill layer 50 and the asphalt layer 51 in FIG. 1. Such gaps could permit water to seep downwardly and collect adjacent the foot of the rail, which could weaken or damage the arrangement, for example by freezing and so cracking the surrounding concrete layer (concrete infill layer 50 in FIGS. 3*a* and 3*b*).

Figure 6:
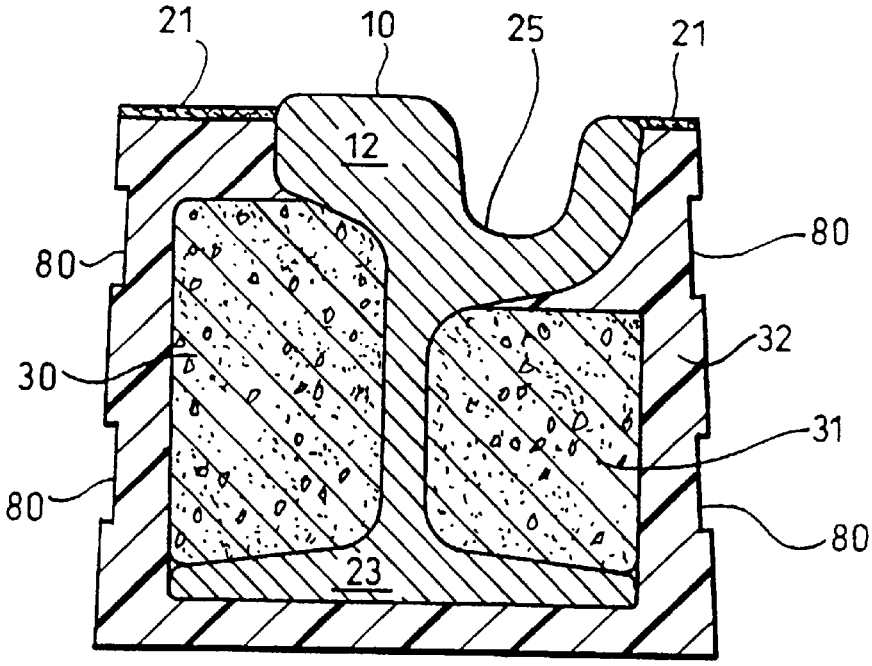

Therefore, in the embodiment of FIG. 6, recesses 80 are formed in the sides of the cured polymer 32 by shaping of the mould walls. When such an embodiment is mounted in a concrete layer formed by flooding the track bed, concrete will enter the recesses 80. This will generate a convoluted boundary between the concrete and the coating 32, which restricts water seepage so that water does not reach the bottom of the coated rail.

Figure 7:
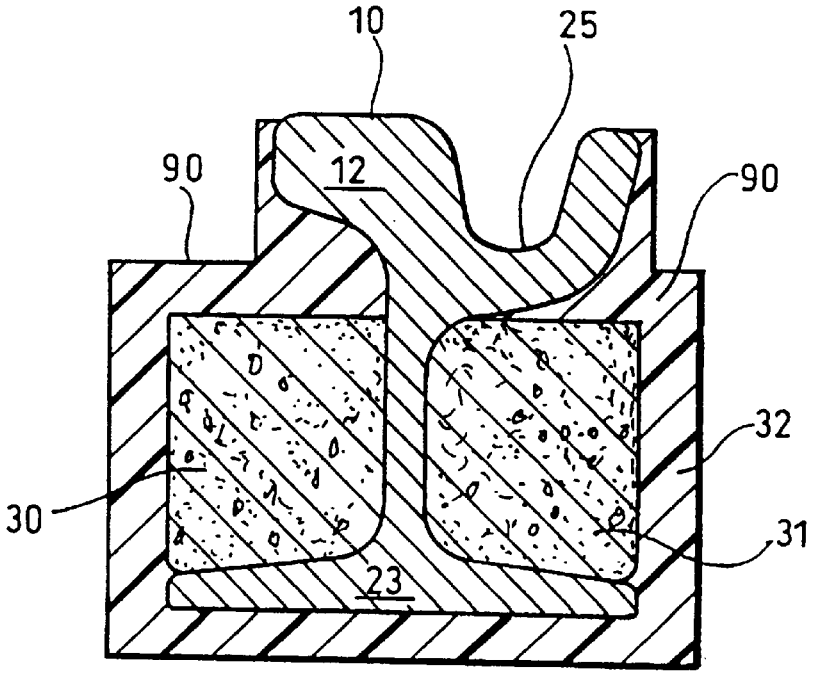

A further embodiment is shown in FIG. 7. This is generally similar to the embodiment of FIG. 5, but instead of being tapered, the cured polymer 32 has steps 90 adjacent the head 12 of the rail 10. Then, the existence of the steps 90 create slots on either side of the rail head 12 which may be filled with asphalt and so minimise the amount of polymer material 32 that is exposed at the ground surface. Such an arrangement is particularly convenient for a track bed of the type shown in FIG. 3, where the ground surface is primarily asphalt, since the asphalt layer 51 can extend into the slots formed by the steps 90 thereby also providing a more secure fixing of the coated rail.

Figure 8:
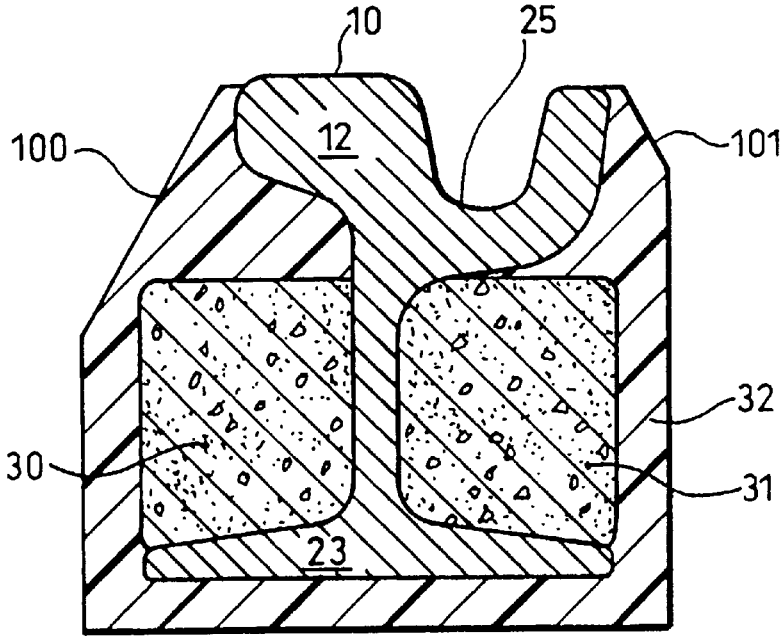

The embodiment of FIG. 8 is similar to that of FIG. 7, and has similar advantages, but in this embodiment the parts 100, 101 of the cured polymer adjacent the head 12 of the rail 10 are tapered rather than stepped.

Figure 9:
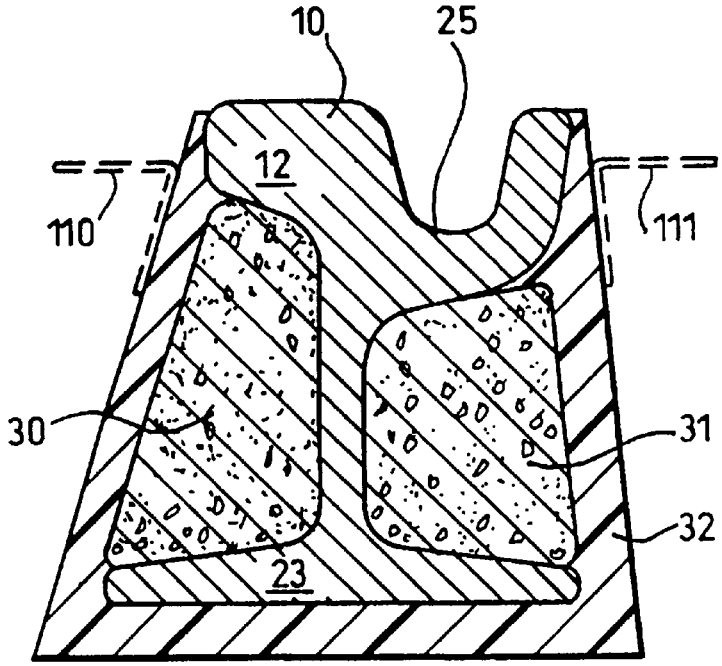

Finally, FIG. 9 shows an embodiment similar to that of FIG. 6, but in which anchor parts 110, 111 are secured to the outer surface of the cured polymer 32, to act as keys to tie the coated rail to eg. surrounding asphalt.

Thus, the present invention provides a simple and effective way of coating a rail with polymer. The polymer coating electrically insulates the rail, and produces reduced noise and reduced vibration. Noise and vibration may be reduced further by providing a rail with concrete block mounted there along. Because the rail is coated with a liquid polymer, the polymer bonds securely to the rail, unlike arrangements in which pre-vulcanised rubber sections are fitted to a rail. By suitably shaping the mould into which the polymer is poured, the amount of polymer may be minimised, to conserve costs, and prevent excessive movement of the rail by deformation of the polymer when the rail is in use. The present invention makes it easy for the exposed surface of the coated rail to have an anti-slip property, since materials placed in the mould will naturally fall to a position adjacent to the head of the rail, since the rail is inverted in the rail when the polymer is poured therein.

Although the present invention has been developed primarily for use in a light railway or tramway system, where the coated rails are mounted eg. in a road to be used by other vehicles, it is applicable to any other rail system.

What is claimed is:

1. A method of laying a rail line comprising two rails, the method comprising:

providing an uncoated rail having a head and a foot;

placing the uncoated rail in an upside down position in a mold having a top and bottom such that the head of the rail is at the bottom of the mold;

pouring a polymer into the mold to coat the rail;

curing the polymer in the mold;

removing the coated rail from the mold after the polymer has cured;

laying two coated rails on a track bed; and providing a further layer of material to embed the coated rails.

2. The method according to claim 1 further comprising the step of placing anti-skid materials in the mold adjacent to the head of the rail after said step of placing.

3. The method according to claim 1 wherein said step of laying comprises placing the coated rails on mounting plates attached to the track bed.

4. The method according to claim 3 further comprising adjusting height of the coated rails above the track bed by interposing at least one spacer block between the coated rails and the mounting plates.

5. The method according to claim 3 further comprising adjusting height of the mounting plates relative to the track bed.

* * * * *

UNITED STATES PATENT AND TRADEMARK OFFICE

CERTIFICATE OF CORRECTION

PATENT NO. : 6,354,512 B2
DATED : March 12, 2002
INVENTOR(S) : Vennell

It is certified that error appears in the above-identified patent and that said Letters Patent is hereby corrected as shown below:

Title page,
Item [73], should read -- [73] Assignee: ALH Rail Coatings Limited, North Lincolnshire, Great Britain --

Signed and Sealed this

Seventeenth Day of December, 2002

JAMES E. ROGAN
*Director of the United States Patent and Trademark Office*